US010549891B2

(12) United States Patent
Gruber

(10) Patent No.: US 10,549,891 B2
(45) Date of Patent: Feb. 4, 2020

(54) SAFETY CLOSURE FOR A CONTAINER WITH A MEDIA SUPPLY LINE

(71) Applicant: KRONES AG, Neutraubling (DE)

(72) Inventor: Robert Gruber, Au (DE)

(73) Assignee: KRONES AG, Neutraubling (DE)

( * ) Notice: Subject to any disclaimer, the term of this patent is extended or adjusted under 35 U.S.C. 154(b) by 0 days.

(21) Appl. No.: 15/406,549

(22) Filed: Jan. 13, 2017

(65) Prior Publication Data

US 2017/0259965 A1 Sep. 14, 2017

(30) Foreign Application Priority Data

Mar. 8, 2016 (DE) ..... 10 2016 203 760

(51) Int. Cl.

| | |
|---|---|
| ***B65D 43/26*** | (2006.01) |
| ***B05B 12/14*** | (2006.01) |
| ***B08B 9/08*** | (2006.01) |
| ***B65D 55/02*** | (2006.01) |

(52) U.S. Cl.

CPC ..... *B65D 43/267* (2013.01); *B05B 12/14* (2013.01); *B08B 9/0813* (2013.01); *B65D 55/02* (2013.01)

(58) Field of Classification Search

CPC ..... B65D 43/267; B65D 55/02; F16J 13/24; B08B 9/0813; A47J 36/10

See application file for complete search history.

(56) References Cited

U.S. PATENT DOCUMENTS

| | | | | |
|---|---|---|---|---|
| 1,980,064 | A * | 11/1934 | Johnston | A47L 15/23 134/111 |
| 2,706,999 | A | 4/1955 | Pickard | |
| 2,938,648 | A | 5/1960 | Phelan et al. | |
| 3,547,589 | A | 12/1970 | Rice et al. | |
| 3,628,687 | A | 12/1971 | Townsend | |
| 4,294,378 | A | 10/1981 | Rabinovich | |

(Continued)

FOREIGN PATENT DOCUMENTS

| | | | |
|---|---|---|---|
| CN | 1367752 | A | 9/2002 |
| CN | 2508665 | Y | 9/2002 |
| CN | 204265732 | U | 4/2015 |

(Continued)

OTHER PUBLICATIONS

State Intellectual Property Office of the People's Republic of China, Office Action and Search Report Issued in Application No. 201710025839.4, dated Aug. 1, 2018, 9 pages. (Submitted with Partial Translation).

*Primary Examiner* — Spencer E Bell
(74) *Attorney, Agent, or Firm* — McCoy Russell LLP

(57) ABSTRACT

A safety closure for or on a container with a media supply line is described. The safety closure comprises: a lid which is actuated in particular mechanically for closing the container; a shut-off device for shutting off the media supply line; a pivoting lever with an actuating arm for pressing on the lid and with an in particular opposite first locking element; and a second locking element which is drive-coupled to the shut-off device and, which as a stop for the first locking element, being selectively operative when the shut-off device is open, is configured such that the lid can not be opened. Accidentally opening the lid when the container is spray rinsed can thereby be prevented in a simple and reliable manner.

19 Claims, 4 Drawing Sheets

(56) References Cited

U.S. PATENT DOCUMENTS 6,793,084 B1 9/2004 Wunsch

FOREIGN PATENT DOCUMENTS

| | | | |
|---|---|---|---|
| DE | 7724998 | U1 | 4/1978 |
| DE | 3102525 | A1 | 12/1981 |
| DE | 3640440 | A1 | 6/1988 |
| GB | 1416707 | A | 12/1975 |
| GB | 2200162 | A | 7/1988 |
| WO | 9310914 | A1 | 6/1993 |
| WO | 2012079746 | A1 | 6/2012 |
| WO | 2015016783 | A1 | 2/2015 |

* cited by examiner

SAFETY CLOSURE FOR A CONTAINER WITH A MEDIA SUPPLY LINE

CROSS-REFERENCE TO RELATED APPLICATIONS

The present application claims priority to German Patent Application No. 10 2016 203 760.9, entitled "Safety Closure for a Container with a Media Supply Line," filed Mar. 8, 2016. The entire contents of which are hereby incorporated by reference for all purposes.

TECHNICAL FIELD

The present disclosure relates to a safety closure for a container with a media supply line, in particular a cleaning line, and a correspondingly secured container, in particular a dosing container.

BACKGROUND AND SUMMARY

For containers integrated into production systems with manually openable lids and with a media feed line for cleaning, in particular spray rinsing the container, for a hot water supply or the like, common safety requirements according to the machinery directive require suitable technical measures to avoid personal injuries occurring due to faulty operation. This risk arises in principle where containers are opened during the supply of hot water, aggressive cleaning agents, or similar media. A particular risk there arises from spray heads which distribute, for example, hot water or cleaning agents under pressure over a large area.

This problem is encountered in the food industry, in particular in the beverage industry, in particular with containers for dosing small quantities such as, for example, in a brewery with hops addition containers, additive containers or generally with containers for dosing additives during brewing. In principle, however, this applies to all containers in which manual handling of the lids is practicable.

Safety devices known from prior art are mostly configured to be electrical. Faulty opening of controllable shut-off fittings in supply lines can be recognized by way of sensors detecting the opening state of the lid, as known for example from WO 2012/079746 A1, and electrical signal transmission. In addition, signals from the door switch can in system controllers programmable from memory be transmitted in order to prevent inadvertent opening of supplying shut-off devices by appropriate signal processing. The inadvertent opening of supplying shut-off devices can also be prevented by way of electrical hardware wiring.

However, an electrically controlled lid guard is complex due to the necessary hardware, software programming and the comparatively complex start of operation.

In addition, such electrical lid guard requires flawless operation of the entire control circuit, including the door switch, various signal lines, the central control unit and possibly employed electrically controlled pilot control devices for pneumatically controlled shut-off devices. The likelihood of failure of individual components adds up. Safety-relevant problems can additionally arise from interfaces between system components from different suppliers.

As an alternative to an electrical lid guard, padlocks for purely mechanical protection are used. However, they merely ensure the authenticity of the key in the operator's hand, but do not provide any protection against faulty operation.

A safety closure can according to WO 2012/079746 A1 alternatively be configured to be substantially two-stage in order to first enable pressure relief or the like by limited opening and to thereby prevent the lid from bursting open in an uncontrolled manner. However, an electrical door switch is also in this context additionally used.

There is therefore a need for a reliable and technically simple safety closure which prevents uncontrolled and/or inadvertent and/or faulty opening of a mechanically actuated lid on a container with a media supply line for safety-relevant media such as, for example, cleaning agents.

This object is satisfied by a safety closure configured for or on a container with a media supply line. The container is, in particular, a dosing container. The media supply line may be used for spray rinsing the container, in particular for cleaning such as in the CIP (cleaning-in-place) method.

The safety closure comprises: a lid which can be actuated, in particular, mechanically actuated, for closing the container; a shut-off device for shutting off the media supply line; a pivoting lever with an actuating arm for placing the lid on the container and with an opposite first locking element; and a second locking element which is drive-coupled to the shut-off device and, which as a stop for the first locking element being selectively operative when the shut-off device is open, is configured such that the lid cannot be opened.

This is to be understood as meaning that the non-opened lid acts as a splash guard from the interior of the container to the exterior. As a result, operators are protected against scalding and/or chemical burns during spray rinsing of the container with liquid media and/or disinfectants which could otherwise escape when the lid is open and the shut-off device is open.

The first locking element is, for example, a lever arm or a disk. The second locking element is configured in such a way that it mechanically blocks the first locking element when the shut-off device is open and thereby prevents the lid from being lifted, thereby providing a splash guard. The pivoting lever may be between the actuating arm and the first locking element mounted rotatably, in particular about a horizontal tilting axis.

The actuating arm may be connected to the lid, for example with a joint. As a result, the lid can be lifted in a manner suspended from the actuating arm. However, an actuating arm detachable from the lid is also conceivable, which for closure engages, for example, in a groove formed in the lid.

The shut-off device may be a disk valve, in particular a manually operated manual flap. Furthermore, other functionally suitable shut-off devices, such as a ball valve or the like, can also be employed. The second locking element may be fixedly connected to the shut-off device, for example having a positive-fit connection to a handle formed on the shut-off device.

In one embodiment, the second locking element is also configured such that the first locking element blocks the shut-off device in a closed position by way of the second locking element when the lid is open. Accordingly, the second locking element is configured such that it releases the first locking element only when the shut-off device is closed.

The lid can therefore be opened only when the shut-off device is closed. Accordingly, the shut-off device can only be opened when the lid is closed. The container and lid are configured and dimensioned in such a manner that the unlocked lid can be manually opened, in particular to fill a product component and/or a product additive.

In at least one example, the second locking element comprises a recess which, when the shut-off device is closed, is aligned flush with the first locking element such that the first locking element tilts into the recess when the lid is opened. When the lid is open, the control lever engages in a positive-fit manner into the recess and prevents the shut-off device from opening.

In at least one example, the second locking element is a locking disk with a recess for the first locking element. The locking disk can be coupled to the shut-off device in a simple fixedly connected manner or by way of a gear. The recess enables a technically simple and reliable positive-fit connection to the first locking element.

In at least one example, the first locking element comprises a recess for the second locking element. The first locking element is then in particular configured as a disk and can be pivoted together with the lid about a vertical axis of rotation.

The second locking element engages in positive-fit manner in the recess of the first locking element when the lid is closed and the shut-off device is open and therefore acts as a mechanically blocking stop for the first locking element which prevents the lid from opening. Conversely, the first locking element can for opening the lid only be pivoted/rotated into the recess of the second locking element when the shut-off device is closed.

In at least one embodiment, the second locking element is movable about an axis of rotation which is oriented orthogonally to a pivot axis of the pivoting lever. This enables simple changeover between a stop of the first locking element against the second locking element and positive-fit engagement of the first locking element into the recess of the second locking element.

In at least one embodiment, the shut-off device can be opened/closed manually by way of an actuating lever. The second locking element is then fixedly connected to the actuating lever. This allows for particularly reliable and simple locking of the closed lid or shut-off device by way of a mechanical lock, in particular without electrical or pneumatic actuators.

The container is, in particular, a dosing container. The lid may then be configured for closing a filling opening for a product component. Such containers with conventional capacity are particularly suitable for manual/mechanical actuation and locking of the lid.

A spray rinsing device for the container may be connected to the media supply line. The spray rinsing device comprises, for example, a pump and/or an overpressure supply line for a liquid medium, as well as at least one spray rinse nozzle within the container. This allows efficient rinsing and/or cleaning within the meaning of CIP.

An electrically or pneumatically actuated valve for shutting off/releasing the media supply line may be additionally provided. This valve is used for the centrally controlled supply of, for example, cleaning agents and/or water and is then configured in sequence with the mechanical shut-off device of the safety closure, in particular upstream thereof. This allows for central control of cleaning processes without obstructing the process sequence due to the securing by way of the mechanical shut-off device.

In at least one embodiment, the pivoting lever is rotatably mounted at the side of the lid on the container. The actuating arm of the pivoting lever then engages across the lid. The first locking element can then in a simple manner be arranged opposite to the actuating arm and reach into the region of the second locking element. The pivoting lever is mounted, for example, on a bearing support rotatable about a horizontal or vertical pivot axis. The bearing support can be formed on the container or, for example, attached to the media supply line.

In at least one example, the safety closure further comprises a lock for the actuating arm that is attached to the container in a position of the lid that seals the container. The lock can be configured, for example, to be pivotable, in particular about a horizontal axis of rotation in order to release the actuating arm for completely opening the lid. The actuating arm can thereby be mechanically relieved for sealingly pressing the lid onto the container.

In at least one embodiment, the lid is configured for manual opening/closing.

The object is also satisfied by a container, which is configured as a dosing container for a product component or a product additive, in particular for producing a beverage, with a media supply line and a safety closure according to at least one of the embodiments described above. Product components are, for example, hops/hops products, color beer, aromas and raw materials. Product additives are, for example, enzymes, lactic acid, mineral acid and filter aids.

In at least one example, the container is then configured for stationary operation in a production facility for foodstuffs such as, for example, beverages and, in particular, beer, and the media supply line is configured for rinsing and/or cleaning without disassembling the dosing container within the meaning of CIP. Cleaning the container can therefore, when the safety closure is correctly positioned, be performed automatically and without transporting the container and without assembly/disassembly of the media supply line. The production facility can, for example, be installed in a brewing house or in a cold area of a brewery. The container can in principle just as well be configured to be mobile, in particular drivable, and can be connected to a respective production facility by way of hoses or similar lines.

In at least one example, the container is configured as a hops delivery container. The safety closure can be particularly advantageously used on such a container, as well as on other containers for brewing additives.

BRIEF DESCRIPTION OF THE FIGURES

Preferred embodiments of the present disclosure are illustrated in the drawings, where.

DETAILED DESCRIPTION

FIGS. 1-4 show the relative positioning of various components of the safety closure and container. If shown directly contacting each other, or directly coupled, then such components may be referred to as directly contacting or directly coupled, respectively, at least in one example. Similarly, components shown contiguous or adjacent to one another may be contiguous or adjacent to each other, respectively, at least in one example. As an example, components lying in face-sharing contact with each other may be referred to as in face-sharing contact or physically contacting one another. As another example, elements positioned apart from each other with only a space there-between and no other components may be referred to as such, in at least one example.

As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Figure 1:
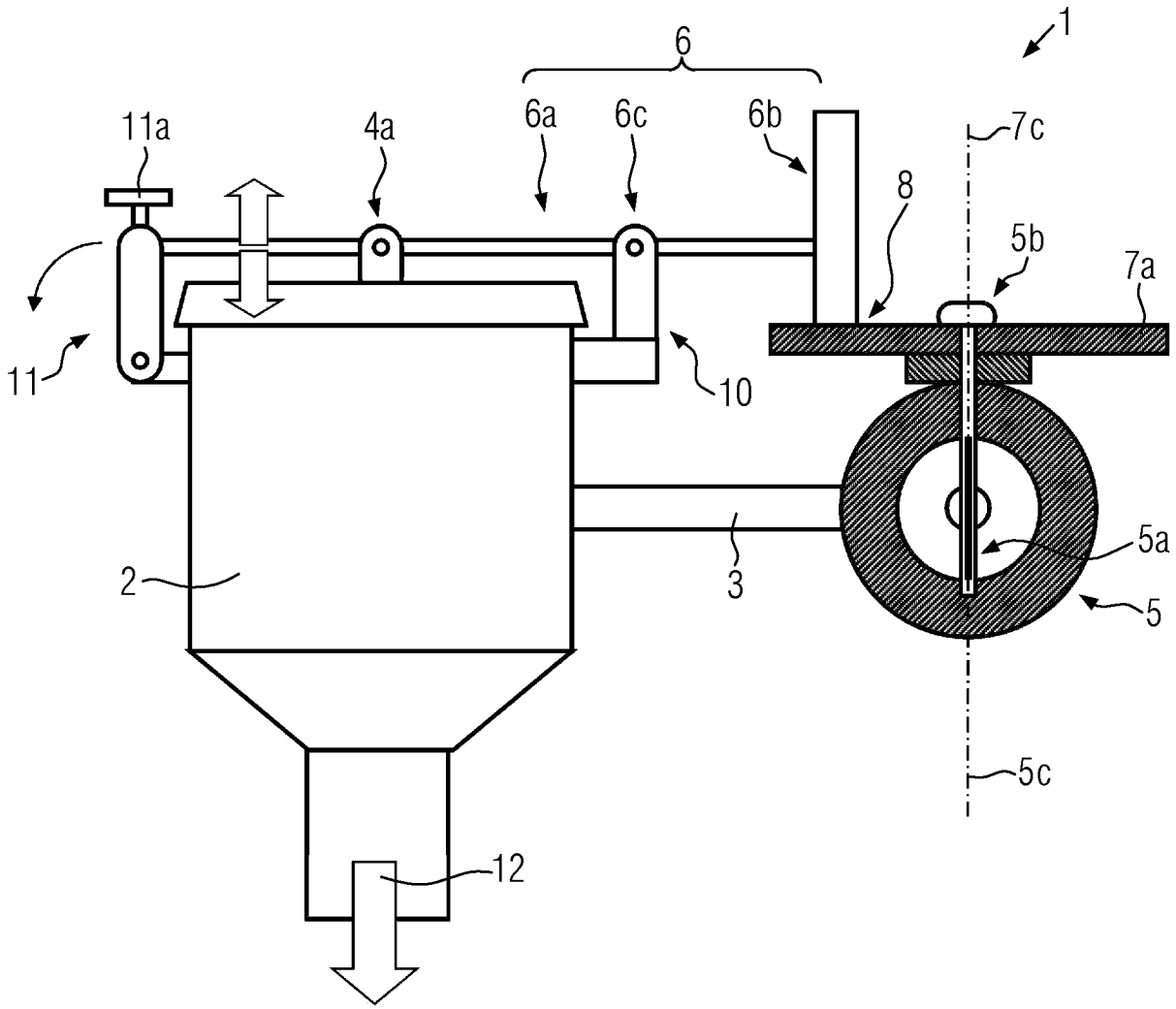
FIG. 1 shows a schematic side view of a first embodiment with the valve open and the lid closed.
Figure 2:
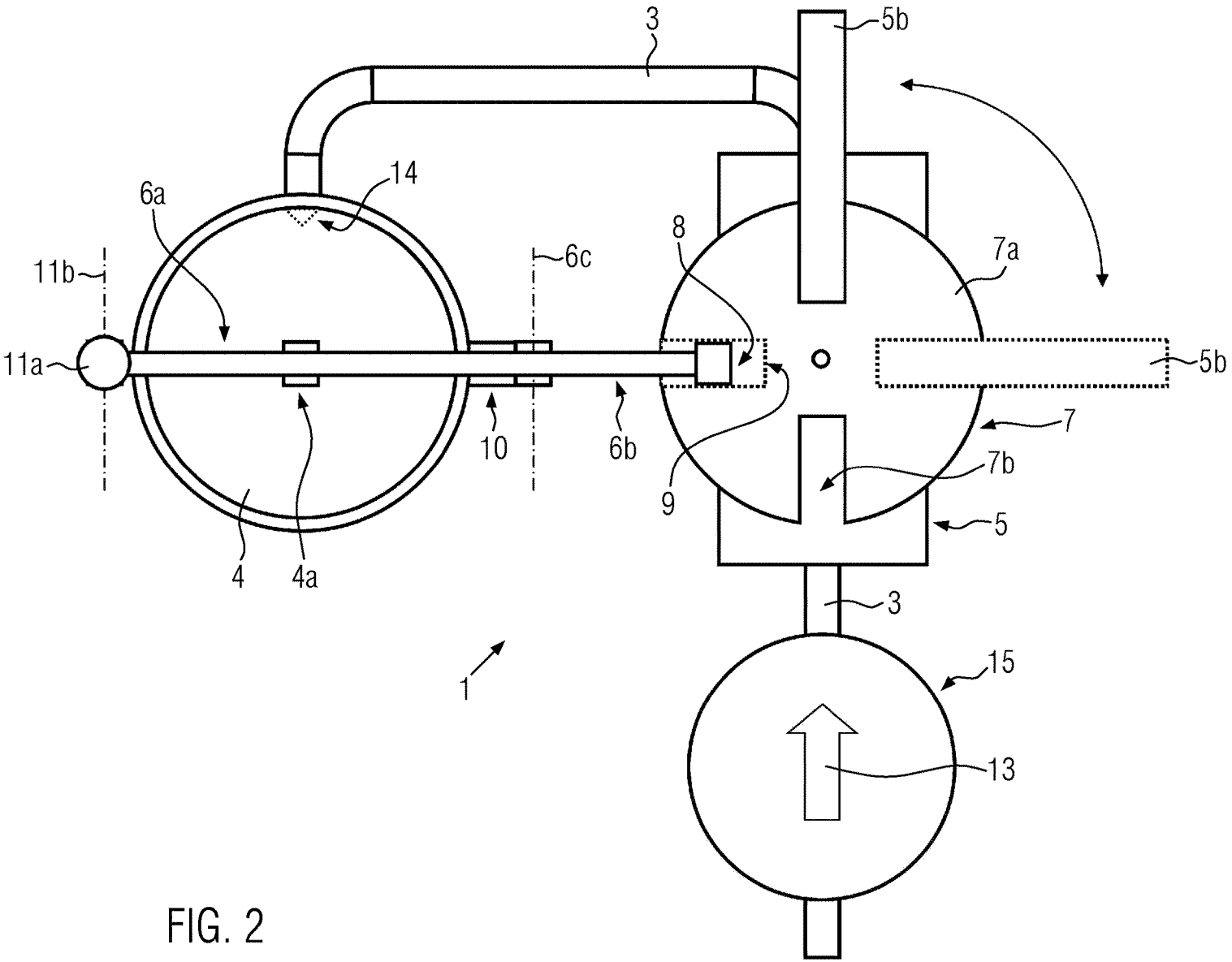
FIG. 2 shows a schematic top view of the arrangement according to FIG. 1.

As can be seen schematically in FIGS. 1 and 2, safety closure 1 is according to a first preferred embodiment formed on a container 2 with a media supply line 3 for rinsing and/or cleaning container 2. Safety closure 1 comprises: a vertically tiltable lid 4 for manually closing container 2; a shut-off device 5 for manually closing media supply line 3; a pivoting lever 6 with an actuating arm 6*a* for placing lid 4 and with an oppositely disposed first locking element 6*b*; and a second locking element 7 which is drive-coupled to shut-off device 5 and locks or releases a motion of first locking element 6*b* for the purpose of unlocking lid 4. First locking element 6*b* is configured, for example, as a lever arm, a disk segment or the like.

Pivoting lever 6 may be rotatably mounted about a horizontal pivot axis 6*c*. Second locking element 7 may be embodied as a locking disk 7*a* with a recess 7*b* rotatable about a vertical axis of rotation 7*c*.

Shut-off device 5 may be configured as a manual flap, i.e. as a disk valve with a flap 5*a* and a handle 5*b* for manually opening/closing. This is schematically indicated in FIG. 2 as a double arrow, where the actuating directions are merely by way of example. Flap 5*a* is mounted in shut-off device 5 rotatable about an axis of rotation 5*c* for closing shut-off device 5. Axes of rotation 5*c*, 7*c* may be identical for directly coupling locking disk 7*a* and flap 5*a* to each other. Other shut-off devices which can be actuated by a rotational motion about an axis are also conceivable.

It is evident from FIG. 1 that second locking element 7, in particular locking disc 7*a*, is configured as a stop 8, being selectively operative when the shut-off device 5 is open, for first locking element 6*b* so that lid 4 cannot be opened when shut-off device 5 is open.

Figure 3:
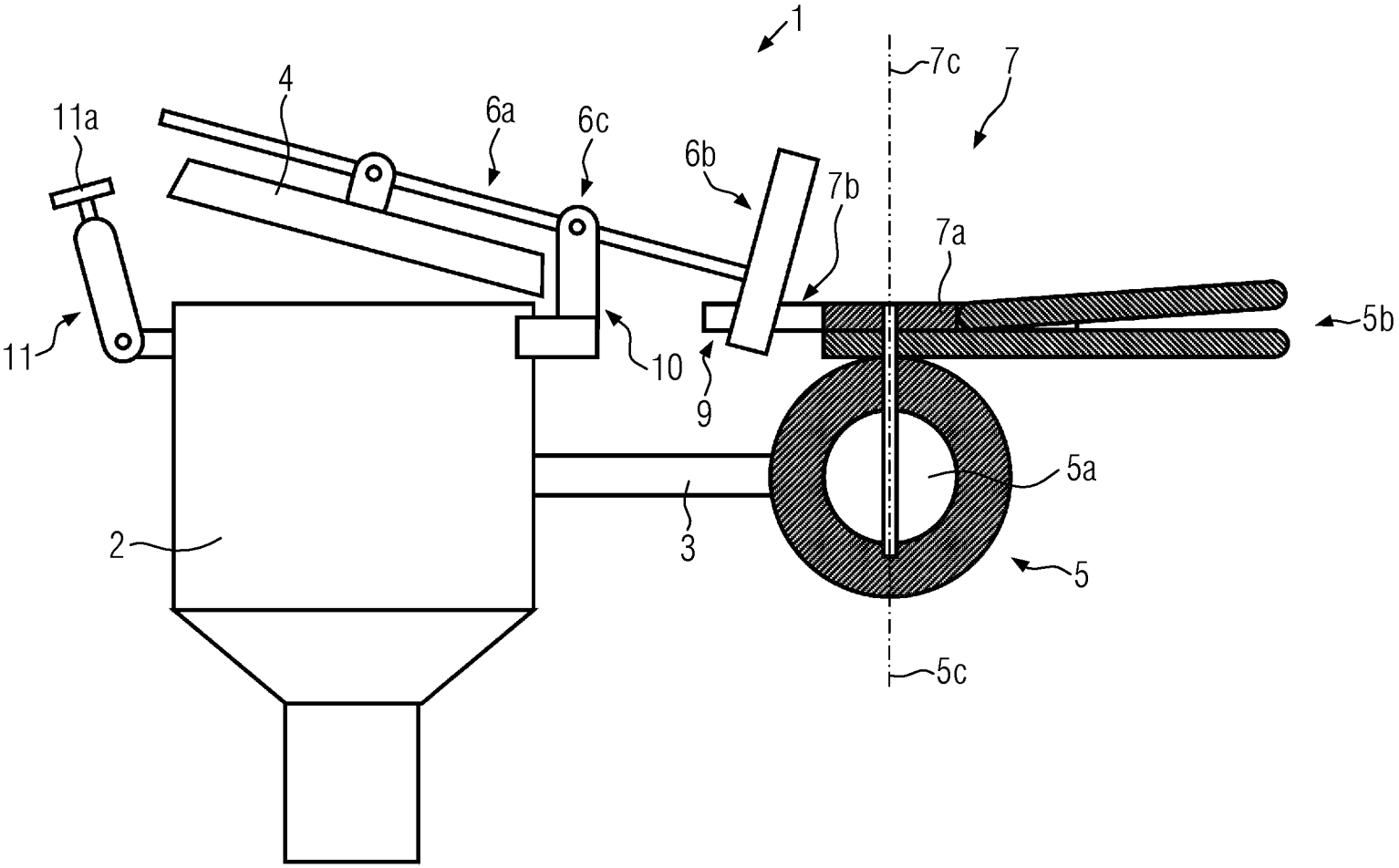
FIG. 3 shows a view according to FIG. 1 with the valve closed and the lid open.

It is evident in particular from FIG. 3 that first locking element 6*b* can only be tilted into/through recess 7*b* when shut-off device 5 is closed, namely when first locking element 6*b* is in the top view (of FIG. 2) aligned flush with the recess 7*b*, i.e. locking disk 7*a* rests in a corresponding rotational position. This allows lid 4 to be opened, as a result of which also shut-off device 5 is blocked in its closed position. Position 9 of recess 7*b* being in flush alignment with first locking element 6*b* and the associated position of handle 5*b* are in FIG. 2 for better understanding indicated by dotted lines.

A bearing support 10 for pivoting lever 6 protruding laterally toward second locking element 7 over lid 4 may be formed on container 2. Alternatively, bearing support 10 can also be attached, for example, to a tubing, such as media supply line 3.

A lock 11 for closed lid 4 may be also formed on container 2. As evidenced by FIGS. 2 and 3, lock 11 can comprise a locking screw 11*a* or the like and, for example, can be pivoted about a horizontal axis of rotation 11*b* in order to release actuating lever 6*a* for opening lid 4 after locking screw 11*a* has been released.

Lid 4 may comprise a support 4*a* on which lid 4 is suspended on actuating lever 6*a*. Lid 4 is mounted preferably in a rotationally fixed manner but tiltable about a horizontal axis of rotation on actuating lever 6*a*. The lid 4 can by use of actuating lever 6*a* be placed on container 2 and lifted off from the latter.

Container 2 may be configured as a dosing container. When lid 4 is open, a product component 12 (indicated schematically in FIG. 1 by a block arrow), a product additive or the like can be filled into container 2. When lid 4 is closed, container 2 can by use of media supply line 3 be rinsed, cleaned and, in particular, spray rinsed with a liquid medium 13, such as, for example, hot water. For this purpose, at least one spray rinsing device 14, for example in the form of a spray nozzle (shown) and/or a pump (not shown) and/or a similar device for supplying liquid medium 13 subject to a suitable overpressure, may be provided on media supply line 3.

The liquid medium can in principle contain a rinsing agent, a cleaning agent, a disinfecting agent, at least one technical adjuvant and/or a product. Technical adjuvants can also be part of the product additives and are, for example, enzymes, calcium chloride, acid and solvents other than water.

FIG. 2 schematically shows an electrically and/or pneumatically operated valve 15 for releasing, shutting off and/or dosing the liquid medium 13 in particular in a centrally controlled manner. Once second locking element 7 acts as a stop 8 for first locking element 6*b* and shut-off device 5 is open, a predetermined process for rinsing, cleaning and/or disinfecting container 2 can without further restriction be automatically controlled by closure lock 1.

Figure 4:
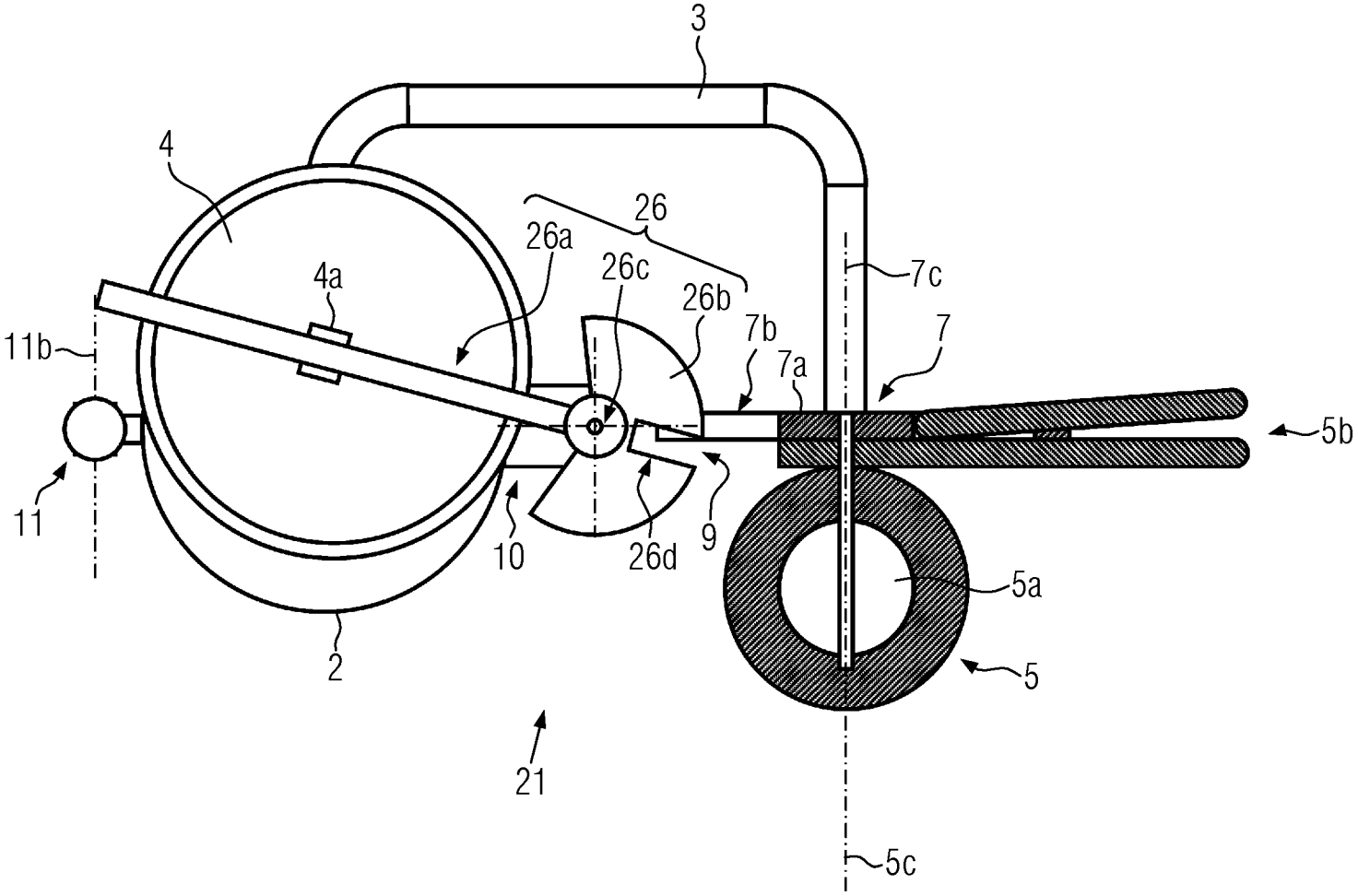
FIG. 4 shows a schematic top view of a second embodiment with the valve closed and the lid open.

As is evident from FIG. 4, safety closure 21 can according to a second preferred embodiment alternatively be configured for a pivoting lever 26, which can be pivoted about a vertical pivot axis 26*c* , and lid 4. Pivoting lever 26 comprises an actuating arm 26*a* which may be fixedly connected to lid 4 by support 4*a*, and a first locking element 26*b* which cooperates operably with second locking element 7 like in the first embodiment. First locking element 26*b* may then be formed to be disk-shaped with a recess 26*d*, for example, a notch.

With both safety closures 1, 21, lid 4 can only be opened when recess 7*b* of locking disk 7*a* is with respect to first locking element 6*b*, 26*b* oriented such that it can pivot into recess 7*b* . Otherwise, locking disk 7*a* acts as a stop 8 for first locking element 6*b*, 26*b* in order to prevent lid 4 from being opened.

In the second embodiment, shut-off device 5 can be opened only when recess 26*d* of first locking element 26*b* is aligned flush with second locking element 7, in particular with locking disk 7*a*. In both variants, the pivot axes 6*c*, 26*c* may be oriented orthogonally to the axis of rotation 7*c* of locking disk 7*a*.

For the remainder, all the structural elements described in the context to the first embodiment having corresponding functions can also be present in the second embodiment and the associated container 2 and media supply line 3.

Safety closure 1, 21 is constructed purely mechanically and therefore exhibits particularly high reliability against failure. Accordingly, safety closure 1, 21 can serve as an additional safety measure which in failure-free operation of optional electrically and/or pneumatically operated valve 15 is indeed redundant, but which, due to the sequential arrangement of shut-off device 5 and valve 15, however, has effect for example when a seal breaks in valve 15, i.e. also when the latter is faultlessly actuated and/or set.

Second locking element 7 is, in at least one embodiment, connected to flap 5*a* as well as to support 5*b* in a rotationally-fixed manner, for example, in a positive-fit manner. However, it would also be conceivable to couple second locking element 7 to shut-off device 5 by way of a gear, a connecting rod, a worm gear, a sprocket/gear rod or the like.

Second locking element 7 could therefore also be configured as a linearly movable slide lock (not shown), operationally corresponding to locking disk 7*a*, with a recess 7*b* for first locking element 6*b*, 26*b*. For such a slide lock, the rotational motion for actuating shut-off device 5 would need to be transformed into a linear motion of the slide lock, for example, with a coupling by way of a sprocket and a gear rod.

It is crucial that the position of recess 7*b* relative to first locking element 6*b*, 26*b* changes depending on the open position of shut-off device 5 as described above, i.e. second locking element 7, possibly also in the form of a control slide, when shut-off device 5 is open acts as a stop 8 for first locking element 6*b*, 26*b*, and recess 7*b* of second locking element 7, when shut-off device 5 is closed, is in a position 9 aligned with first locking element 6*b*, 26*b* so that first locking element 6*b*, 26*b* can pivot into recess 7*b*.

Container 2 and media supply line 3 are suitable for stationary installation and a rinsing and/or cleaning and/or disinfecting process in a food-processing operation, such as, for example, in a brew house or a similar production plant.

Safety closure 1, 21 in a simple and reliable manner ensures protection of the operator from hot and/or aggressive liquid media 13 which could otherwise escape due to an accidental opening of lid 4, in particular during a rinsing and/or cleaning and/or disinfection process. A disinfection process also includes sterilization. The same also applies for disinfectants and sterilization agents.

The electrically and/or pneumatically operated valve 15 can be, for example, a ball valve, a shut-off flap, a slide or the like. Valve 15 could also be actuated hydraulically.

The spray rinsing device 14 can, for example, be understood as being a tube which ends in container 2. Spray rinsing device 14 can also comprise distributing devices, such as an injection head, target jet cleaner, baffle plate or similar devices which spread or fan out the medium. Ring lines with openings are also conceivable.

The invention claimed is:

1. A safety closure for a container with a media supply line for rinsing and/or cleaning said container, comprising:

a lid for closing said container;

a first shut-off device comprising a flap or a first valve for closing said media supply line;

a pivoting lever with an actuating arm for actuating said lid between an open position and a closed position, and with a first locking element, wherein the actuating arm pivots on a pivot point and is connected to the first locking element; and a second locking element which is drive-coupled to said first shut-off device and which has a stop for said first locking element, said second locking element being selectively operative when said first shut-off device is open, and said second locking element is configured such that said lid cannot be opened when said first shut-off device is open.

2. The safety closure according to claim 1, wherein the first locking element is opposite to said actuating arm.

3. The safety closure according to claim 1, where said second locking element is further configured such that said first locking element blocks said second locking element when said lid is open and thereby prevents said first shut-off device from opening.

4. The safety closure according to claim 1, where said second locking element comprises a recess which, when said first shut-off device is closed, is aligned with said first locking element such that said first locking element engages in said recess when said lid is opened.

5. The safety closure according to claim 1, where said second locking element is a locking disk with a recess for said first locking element.

6. The safety closure according to claim 5, where said second locking element is movable about an axis of rotation which is oriented orthogonal to a pivot axis of said pivoting lever.

7. The safety closure according to claim 1, where said first locking element comprises a recess for said second locking element.

8. The safety closure according to claim 7, where said first locking element is configured as a disk.

9. The safety closure according to claim 1, where said first shut-off device is opened/closed manually by way of a handle, and said second locking element is fixedly connected to said handle.

10. The safety closure according to claim 1, where said container is a dosing container and said lid is configured for closing a filling opening for a product component or a product additive.

11. The safety closure according to claim 1, further comprising a spray rinsing device comprising a spray nozzle for said container and connected to said media supply line.

12. The safety closure according to claim 1, further comprising an electrically or pneumatically actuated second shut-off device comprising a second valve for shutting off said media supply line.

13. The safety closure according to claim 1, where said pivoting lever is rotatably mounted in a position that is laterally offset from said lid.

14. The safety closure according to claim 13, where said pivoting lever is mounted on said container.

15. The safety closure according to claim 1, further comprising a lock for said actuating arm, wherein the lock is fastened to said container proximal to said lid and seals said container.

16. The safety closure according to claim 1, where said lid is configured for manual opening/closing.

17. A container, which is configured as a dosing container for a product component or a product additive with a media supply line and a safety closure, said safety closure comprising:

a lid for closing said container;

a first shut-off device comprising a flap or a first valve for closing said media supply line;

a pivoting lever with an actuating arm for actuating said lid between an open position and a closed position, and with a first locking element, wherein the actuating arm pivots on a pivot point and is connected to the first locking element; and a second locking element which is drive-coupled to said first shut-off device and which has a stop for said first locking element, the second locking element being selectively operative when said first shut-off device is open, and the second locking element is configured such that said lid cannot be opened when said first shut-off device is open.

18. The container according to claim 17, where said container is configured as the dosing container for the product component or the product additive for the production of a beverage.

19. The container according to claim 17, where said container is configured for stationary operation in a production facility for foodstuffs such as, for example, beverages and, in particular, beer, and where said media supply line is configured for rinsing and/or cleaning without disassembling said container.

* * * * *